United States Patent [19]

Rothfuss et al.

[11] Patent Number: 4,779,849

[45] Date of Patent: Oct. 25, 1988

[54] GAS WASHING DEVICE WITH REDUCED GAS FLOW UPON WEAR OF GAS SINK

[75] Inventors: Hans Rothfuss, Taunusstein; Jürgen Schnabel, Wiesbaden, both of Fed. Rep. of Germany

[73] Assignee: Didier-Werke AG, Wiesbaden, Fed. Rep. of Germany

[21] Appl. No.: 60,620

[22] Filed: Jun. 11, 1987

[30] Foreign Application Priority Data

Jul. 12, 1986 [DE] Fed. Rep. of Germany ..... 3623609

[51] Int. Cl.[4] ..... C21C 5/48

[52] U.S. Cl. ..... 266/270; 266/87

[58] Field of Search ..... 266/81, 87, 89, 220, 266/270

[56] References Cited

U.S. PATENT DOCUMENTS

| | | | |
|---|---|---|---|
| 2,811,346 | 10/1957 | Spire | 266/220 |
| 3,330,645 | 7/1967 | de Moustier et al. | 266/220 |
| 3,971,548 | 7/1976 | Folgerö et al. | 266/218 |
| 4,331,471 | 5/1982 | Langeneld et al. | 266/220 |
| 4,616,809 | 10/1986 | Hoffgen | 266/220 |

FOREIGN PATENT DOCUMENTS

| | | | |
|---|---|---|---|
| 82078 | 6/1983 | European Pat. Off. . | |
| 1608036 | 12/1970 | Fed. Rep. of Germany . | |
| 3240097 | 5/1984 | Fed. Rep. of Germany . | |
| 3424466 | 1/1985 | Fed. Rep. of Germany . | |
| 1555947 | 1/1968 | France . | |
| 59-38321 | 3/1984 | Japan . | |
| 60-17804 | 5/1985 | Japan . | |
| 1210314 | 10/1970 | United Kingdom . | |
| 2150868 | 7/1985 | United Kingdom | 266/220 |

OTHER PUBLICATIONS

Radex-Rundschau, Heft 3, 1983, S. 179-209, "Einsatz und Verschleiß von Spülsteinen in der Sekundärmetallurgie", Grabner et al., (Partial Translation).

*Primary Examiner*—L. Dewayne Rutledge
*Assistant Examiner*—Robert L. McDowell
*Attorney, Agent, or Firm*—Wenderoth, Lind & Ponack

[57] ABSTRACT

A gas washing device for supplying gas through a metallurgical vessel to molten metal therein includes a gas permeable sink positioned to extend through a wall of the metallurgical vessel. The sink has an inner end to be exposed to the molten metal and subject to wear thereby and an outer end. A gas inlet supplies an operational flow of gas from a gas supply to the outer end of the sink. A device is operatively mounted with respect to the sink and is responsive to a temperature rise indicative of a predetermined extent of wear of the inner end of the sink by the molten metal, to reduce the flow of the gas to a reduced flow less than the operational flow upon the inner end of the sink being worn or eroded to the predetermined extent. A detector detects or measures the reduced flow of gas.

19 Claims, 5 Drawing Sheets

GAS WASHING DEVICE WITH REDUCED GAS FLOW UPON WEAR OF GAS SINK

BACKGROUND OF THE INVENTION

The present invention relates to a gas purging system or gas washing device for supplying gas through a metallurgical vessel to molten metal therein and of the type having a refractory purging brick or sink as well as a gas inlet for supplying an operational flow of gas from a gas supply to the purging or washing brick or sink such that the gas flows through the brick or sink into the molten metal. The present invention more particularly is directed to such a gas purging or washing device improved to respond to a temperature rise indicative of a predetermined extent of wear of the gas permeable brick or sink by the molten metal to reduce the flow of gas to a reduced flow less than the operational flow, thereby maintaining the ability to continue the supply of gas even upon substantial wear of the brick or sink, as well as means for detecting such reduced gas flow.

In such gas purging or washing devices it is necessary to prevent the danger of molten metal breakthrough upon substantial wear or erosion of the gas permeable brick or sink. West German DE-OS No. 32 40 097 discloses a gas purging system including a layer of granular filler material having a melting point below the temperature of the molten metal. When molten metal has eroded or worn the brick or sink to a point such that the molten metal enters the filler material, the filler material melts with the result that a barrier is formed to prevent the molten metal from breaking through. However, due to this barrier the gas purging or washing operation itself also is stopped.

Copending application Ser. No. 877,971 filed June 23, 1986 discloses a gas purging or washing system wherein upon extensive wear of the brick or sink the total gas flow increases. This arrangement enables continuing gas feed but in practice is difficult to employ since it is inappropriate to pass an increased quantity of gas to a highly eroded brick or sink.

West German DE-OS No. 34 24 466 discloses a gas purging system in which electrodes of an electric circuit are provided in the gas purging brick. When the temperature rises due to erosion of the brick, contacts of the electrodes are intended to fuse, as a result of which the electric circuit is closed. However, the purging process ceases if the purging brick has been worn down substantially. Moreover, it is disadvantageous if the electrodes in the purging brick must be located in a probe. European No. EP-82,078 Al discloses an electric wear indicator wherein molten metal, due to its electrical conductivity, is to connect electrodes of an electrical circuit placed at different heights in the purging brick. In this case also the total flow rises with increasing wear of the purging brick so that continued purging is not possible after substantial erosion. Moreover, this arrangement requires that no electrically insulating layers be formed around the electrodes, and this is difficult to achieve in practice.

SUMMARY OF THE INVENTION

With the above discussion in mind, it is an object of the present invention to provide a improved gas purging or washing device whereby it is possible to overcome the above and other prior art disadvantages.

It is a further object of the present invention to provide such a device whereby it is possible to detect substantial erosion of a purging or washing brick while preventing molten metal breakthrough but while still enabling continued flow of the purging or washing gas.

These and other objects are achieved in accordance with the present invention by the provision of means, operatively mounted with respect to the brick or sink and responsive to a temperature rise indicative of a predetermined extent of wear or erosion thereof, i.e. indicative of the fact that the brick or sink has been worn down to a residual height, for reducing the flow of the gas to a reduced flow less than the operational flow upon the inner end of the brick or sink being worn to the predetermined extent. More specifically, upon a temperature rise indicative of such predetermined extent of erosion or wear the cross sectional area available for the supply of the gas is reduced automatically, thereby reducing the gas flow. There is provided means operatively associated with the gas inlet for detecting the reduced flow, thereby giving an indication of erosion of the gas permeable brick or sink to a substantial extent. The brick or sink however need not be replaced immediately, and it is possible to wait for a convenient time for replacement. The total gas flow is reduced to a minimum value, but since the gas flow is not stopped completely it is possible to continue the purging or washing operation. Additionally, to continue a practical purging or washing operation the gas pressure at the gas inlet may be increased to thereby raise the overall gas flow to the molten metal.

In accordance with one preferred embodiment of the present invention the gas permeable brick or sink is in the form of a inner brick and an outer brick confronting each other at a joint area, the inner and outer bricks abutting each other at a first portion of the joint area and being spaced from each other by a chamber at a second portion of the joint area. The reducing means comprises a material which is meltable upon being subjected to the temperature rise, and this material is positioned within the chamber such that upon the material being melted it forms a barrier to the flow of the gas at the second portion of the joint area, with the gas then flowing only at the first portion of the joint area. Preferably the meltable material is a granular or granulated material. Further preferably, the area of the first portion is smaller than the area of the second portion, and particularly the first portion extends circumferentially or peripherally and surrounds or encloses the second portion. In this arrangement, the temperature of the granulate meltable material rises upon erosion of the inner brick, thereby gradually melting the material and reducing the total gas flow. When only the second portion of the joint area is available for the flow of gas, the quantity of gas supplied through the sink is at a minimum, but nevertheless permits continuation of the gas purging or washing operation. The reduction of the quantity of gas being passed can be indicated on a flow meter to show the advanced state of erosion.

In accordance with a further preferred embodiment of the present invention, the reducing means is in the form of a valve incorporated in the gas inlet, the valve including a valve seat and a valve body movable between a first position spaced from the valve seat and a second position toward the valve seat. Temperature sensitive means prevents the valve body from moving to the second position prior to the gas permeable brick or sink being worn to the predetermined extent. The valve body may be in the form of a gas permeable member seated tightly on the valve seat in the second position thereof, and the valve body may be bonded to the valve seat when in the second position. Alternatively, the valve body may be in the form of a gas impermeable member defining with the valve seat a gas passageway in the second position. In this embodiment the valve body also may be bonded to the valve seat in the second position.

The temperature sensitive means may be in the form of a meltable fuse provided between a rod member contacting or connected to the valve body and a locating sleeve mounted on and preferably embedded in the gas permeable brick or sink. The sleeve may be connected to a star-shaped base member supporting the sink. The fuse may be in the form of a meltable portion of the rod member.

The temperature sensitive means alternatively may be in the form of a meltable fuse provided between a first rod member connected to the gas permeable brick or sink and a second rod member contacting or connected to the valve body. The fuse preferably may be formed between inclined confronting end surfaces of the first and second rod members.

The temperature sensitive means still further may be in the form of a bimetallic strip having a first end fixed relative to the gas permeable brick or sink and a second end blocking the valve body from moving to the second position before the temperature rise and deflective or deflectable at the temperature rise to allow the valve body to move to the second position.

In accordance with a further aspect of the present invention there is provided a spring urging the valve body toward the valve seat either in the direction of gas flow or in a direction opposite to the direction of gas flow.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
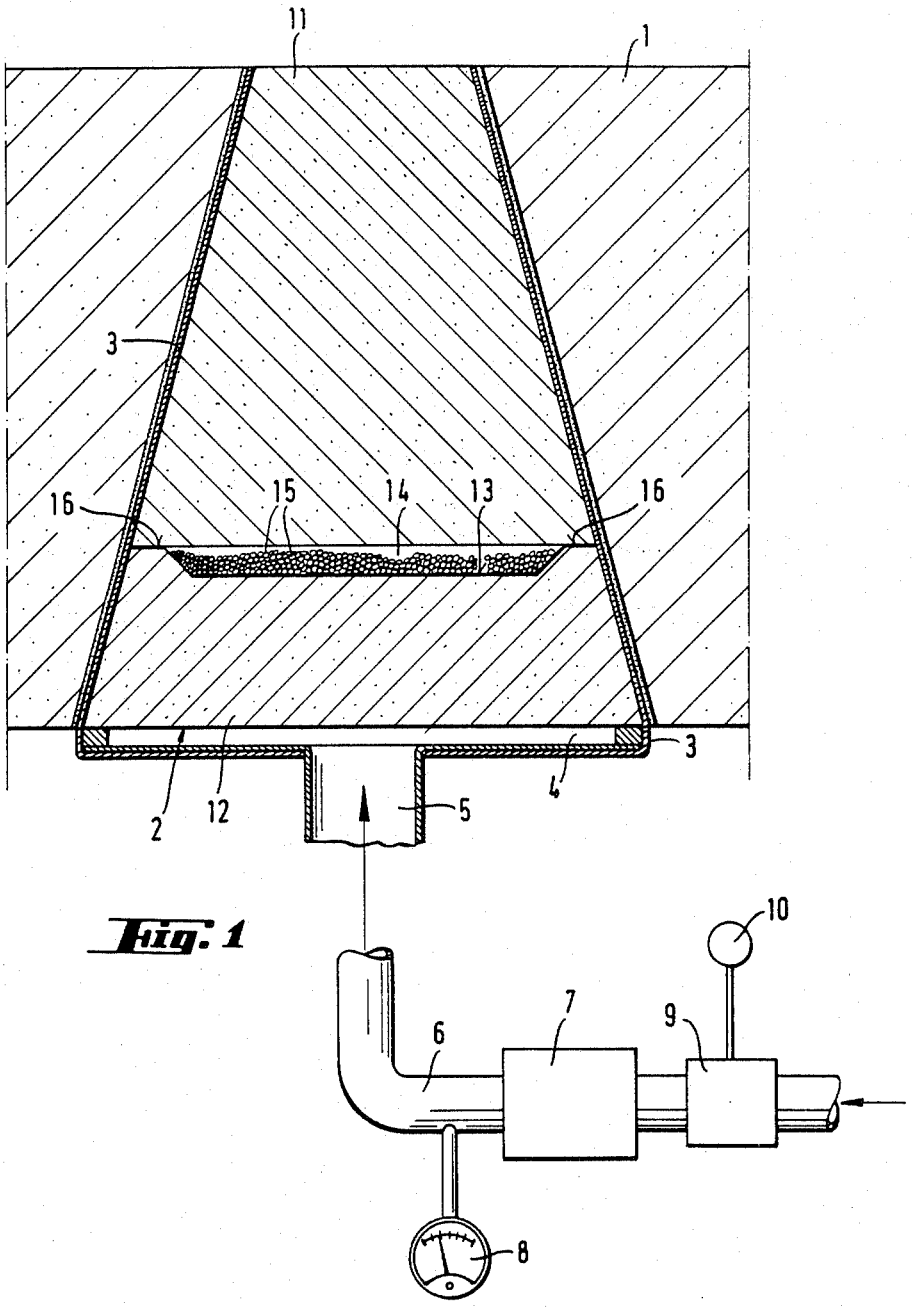
FIG. 1 is a partially schematic and partially sectioned view of a gas purging or washing device according to a first embodiment of the present invention.

In FIG. 1, illustrating a first embodiment of the present invention, there is shown schematically the bottom 1 of a metallurgical vessel adapted to contain therein molten metal. A gas purging or washing brick or sink 2 has a metal, for example steel, cladding 3 and is mounted within an opening in bottom 1 of the vessel. Below sink 2 is provided a gas distributing space 4 having a gas feed or inlet 5 connected to gas line 6 for supplying an operational flow of gas from a gas supply such that the gas passes through sink 2. Particularly, brick or sink 2 is intended to be formed of a gas permeable ceramic material of known composition. A gas flow meter 7 is installed in gas line 6, a manometer 8 is connected to gas line 6, a pressure booster 9 with a pressure limiter is installed upstream of gas flow meter 7, and a warning device 10 is connected to pressure booster 9. The devices 7–10 are illustrated only in FIG. 1, but it is to be understood that such devices are intended to be included in the arrangements of the other embodiments of the present invention.

In the particular embodiment of FIG. 1, the gas purging or washing brick or sink 2 is in the form of an inner, conically tapered wear resistant refractory brick 11 and an outer similarly configured brick 12 serving as a safety brick. Brick 12 has on its inner end a recess 13 forming a chamber 14 between bricks 12, 11. Chamber 14 is filled with a granulate meltable material 15. The bricks 11, 12 abut each other along a first, peripheral area 16, such area surrounding the area of chamber 14. The cross-sectional area occupied by chamber 14 is substantially larger than the cross-sectional area occupied by abutting rim area 16.

The granulate material 15 may be in the form of porcelain bodies, hydrous or water-containing glass rocks, metals or alloys. For example, obsidian with a water content of 1–2 weight percent, perlite with a water content of 3–4 weight percent or pitchstone with a water content of more than 4 weight percent are suitable as glass rocks. Sn, Pb, Zn, Mg, Al, Cu or other metals may be employed to form the granulate material 15. Particularly, a granulate material with a melting point lower than that of the molten metal within the metallurgical vessel is provided.

When, during operation of the metallurgical vessel and the gas purging or washing device, the inner brick 11 has become worn down or eroded (in a known manner), its height or thickness with regard to the thickness of the vessel bottom decreases. This causes a temperature rise of the granulate material 15, such that material 15 melts gradually, thereby causing the melted granulate material to penetrate into brick 12 or even into brick 11. As a result, the melted granulate forms a closure or barrier in the region of chamber 14, and this greatly reduces the area available for the supply of the gas through the sink 2 to the molten metal. After the granulate material 15 has melted, the gas continues to flow only through the rim area 16. As a result, there will be a greatly reduced quantity of gas passed through sink 2, and this will be detected by or read on the gas flow meter 7 as an indication that the brick 11 has been eroded or worn down to a predetermined extent or to a residual height. To continue the desired or washing operation, the gas pressure can be raised by pressure booster 9 within certain limits, such that the purging or washing of the molten metal can be continued if necessary.

Figure 2:
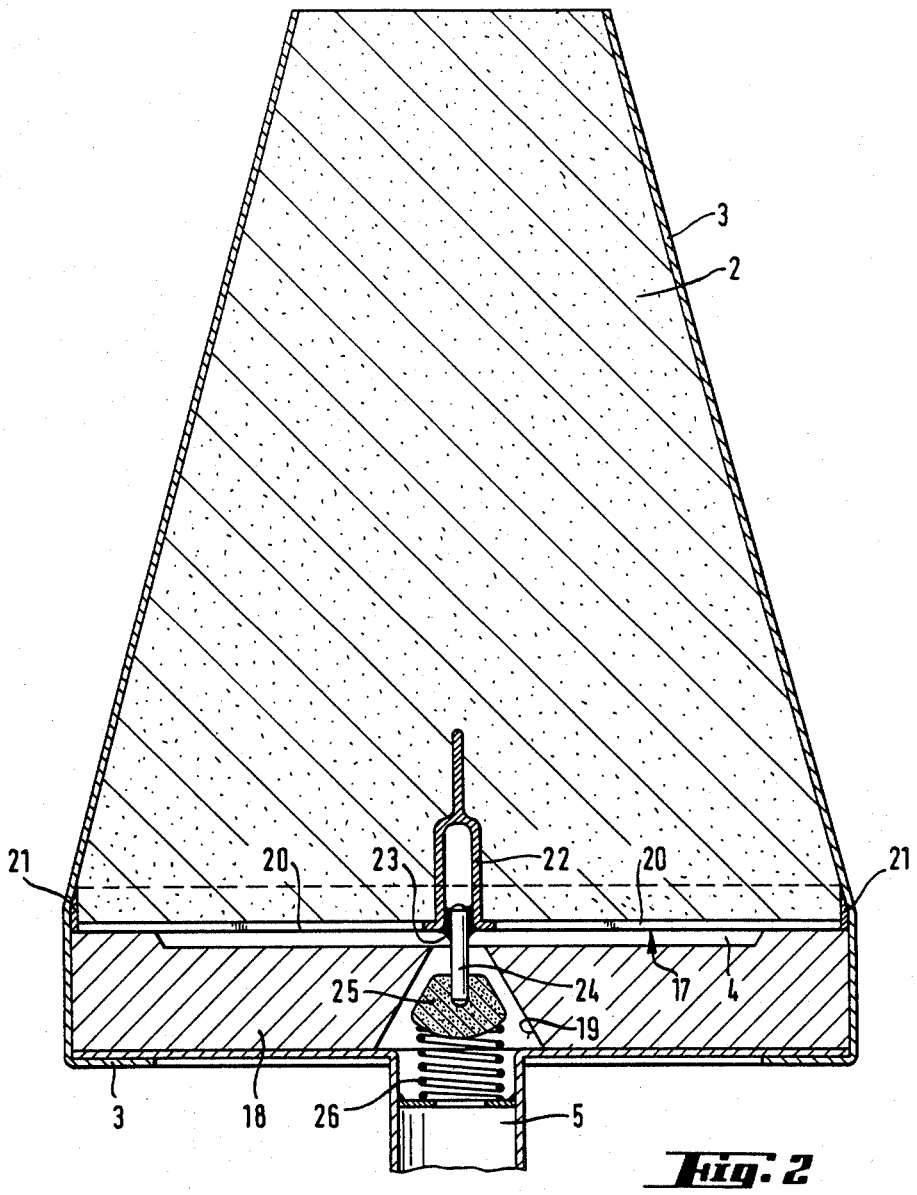
FIG. 2 is a similar view but of a second embodiment of the present invention.
Figure 3:
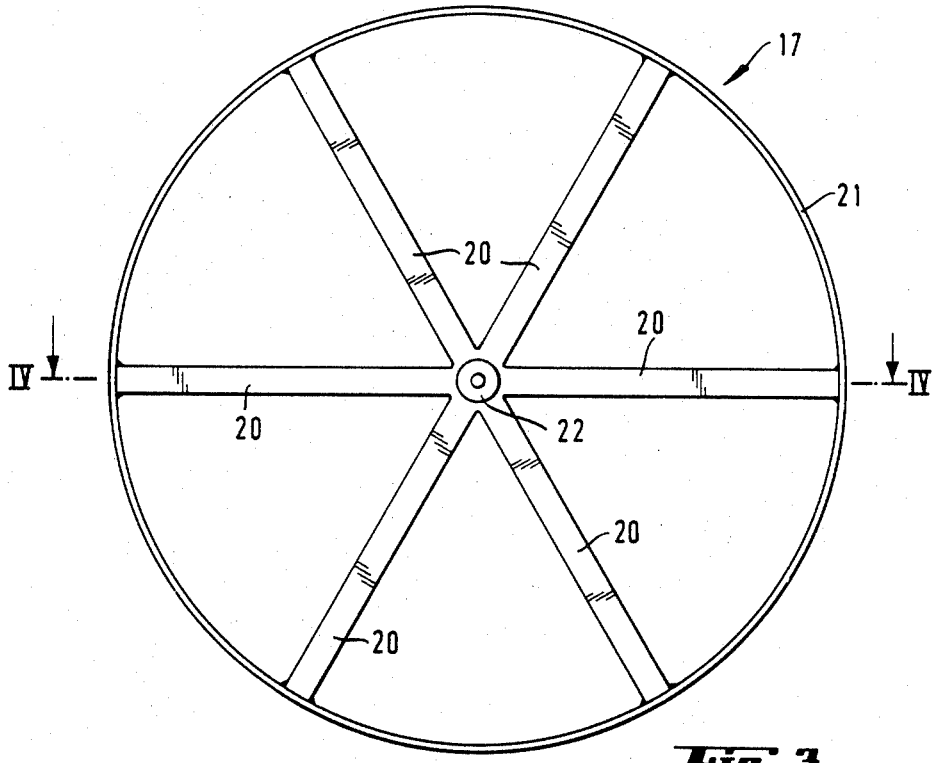
FIG. 3 is a plan view of a supporting member of the embodiment of FIG. 2.
Figure 4:
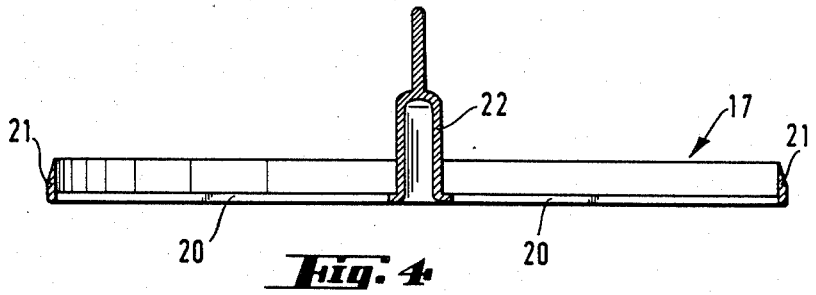
FIG. 4 is a cross sectional view taken along IV—IV of FIG. 3.
Figure 6:
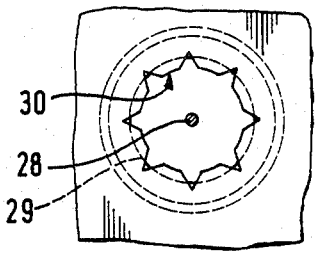
FIG. 6 is a sectional view taken along line VI—VI of FIG. 5.

FIGS. 2 through 4 illustrate a second embodiment of the present invention wherein the gas purging or washing brick or sink 2 is seated or supported on a star-shaped supporting member 17 which in turn rests on or is supported by a gas impermeable ceramic base plate 18 within which is formed the gas distributing space 4. An opening, defining a valve seat 19, extends through base plate 18 and communicates with gas feed inlet 5. The star-shaped supporting member 17 has, as shown in FIG. 6, a plurality of radial arms 20 and an outer ring 21. A locating sleeve 22 is formed at the center of member 17 and is embedded within sink 2. A rod member 24 is secured within locating sleeve 22 by a meltable fuse, such as a soldered joint 23. Rod member 24 is mounted on a valve body 25 formed of a gas permeable ceramic material. Valve seat 19 preferably is provided with a glaze, and likewise the outer surface of valve body 25 directed toward valve seat 19 also can be provided with a glaze.

Star-shaped supporting member 17 is formed of a relatively heat conductive material, for example aluminum, steel or an alloy. Locating sleeve 22 may be formed of the same material or of SiC, Si-metal or cermets. The same is true for rod member 24 Soldering joint 23 may be in the form of a solder of a suitable melting point. However, joint 23 also may be in the form of organic hot-melt adhesives or inorganic substances, such as As, $AlF_3$, MoS, $NH_4Cl$ with a well-defined sublimation temperature. Phosphate glasses, for example, are suitable as the glaze. It would be understood to one skilled in the art however, that other materials than those mentioned above may be provided for the above materials.

In the nonworn or slightly worn state of gas purging or washing brick or sink 2, the fuse or joint 23 holds rod member 24 in such a manner that the valve body 25 is maintained at an open position spaced from valve seat 19. The purging or washing gas therefore can flow without impediment into the gas distributing chamber 4 and then through the brick or sink 2 to the molten metal. However, when the brick or sink 2 has been eroded or worn down to a predetermined extent, i.e. to a residual height, there will be a temperature rise at the heat conducting star-shaped supporting member 17 of an extent such as to cause the soldered joint or fuse 23 to melt. As a result, the valve body 25 will be pressed against valve seat 19, either under the action of a pressure spring 26 or due to the pressure of the washing gas alone. As a result, the gas flow is abruptly reduced. The gas flow is not completely stopped, since the valve body 25 is gas permeable. The glaze leads to the bonding of valve body 25 to valve seat 19, thereby providing an additional safety measure against the breakthrough of molten metal.

The gas flow meter 7 (FIG. 1) detects or indicates the abrupt reduction of the quantity of gas passed. The gas pressure can be increased by booster 9 to continue the operation of washing or purging of the molten metal. The increase of the gas pressure can be monitored on manometer 8, and the raised pressure can be limited to a maximum value by means of the warning device 10 and the pressure limiter.

Figure 5:
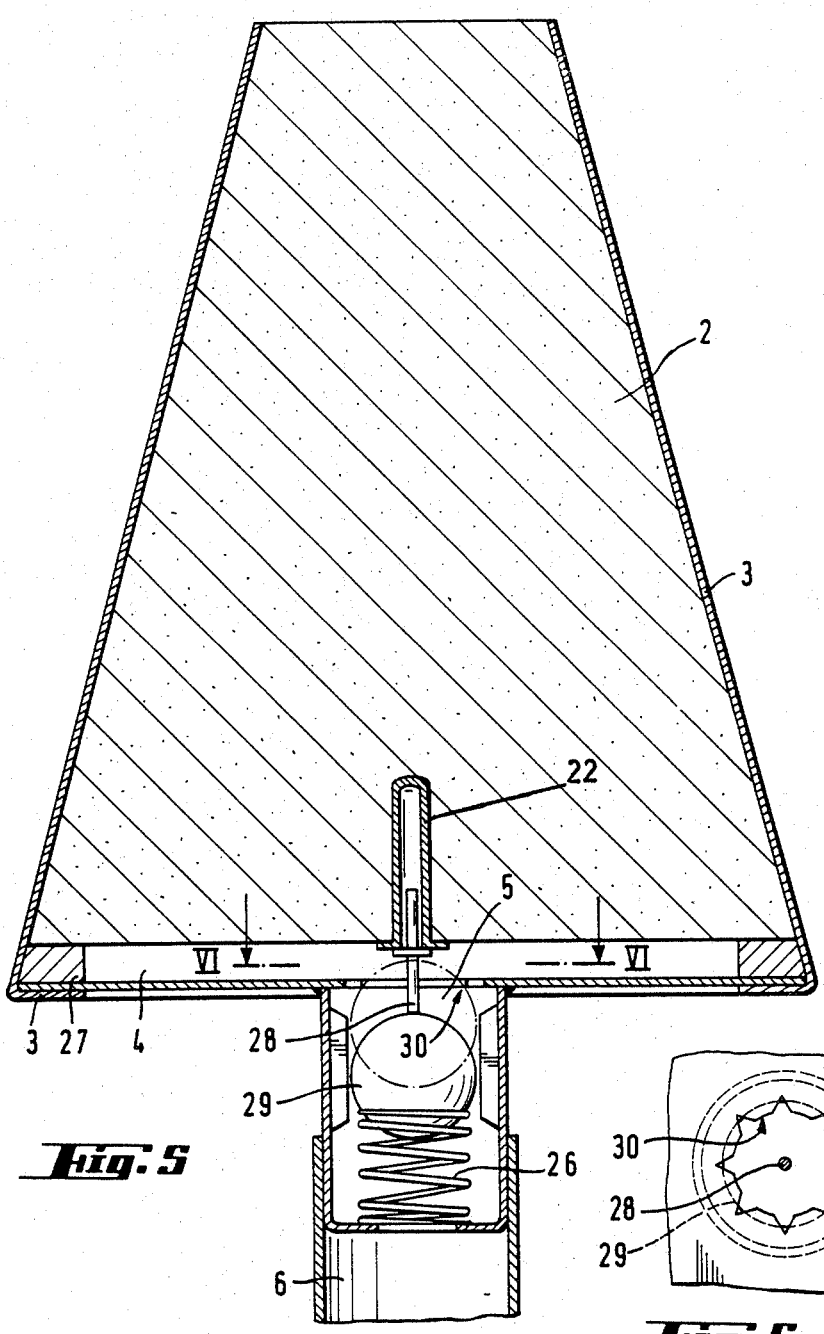
FIG. 5 is a view somewhat similar to FIG. 2 but of a still further embodiment.

In the embodiment of FIGS. 5 and 6, locating sleeve 22 is embedded in sink 2 which is supported on a ring 27. A fusable pin or rod member 28 is positioned within sleeve 22 and contacts a ball-shaped valve body 29, thereby holding valve body 29 in an open position away from a valve seat 30 against the force of a pressure spring 26. In this position, the valve is opened such that there is an unrestricted flow of gas into distributing chamber 4.

When the brick or sink 2 has been eroded or worn down to a predetermined extent or to a residual height, the temperature in the area of sleeve 22 and of pin or rod member 28 rises to an extent such that fusable pin or rod member 28 melts. As a result, spring 26 forces valve body 29 against valve seat 30. Valve seat 30 has a star-shaped or irregular configuration as shown in FIG. 6, such that even when valve body 29 seats on valve seat 30 the flow of gas will be abruptly reduced but not stopped. The gas purging or washing operation thereby can be continued, for example by increasing the gas pressure in the manner discussed above.

Figure 7:
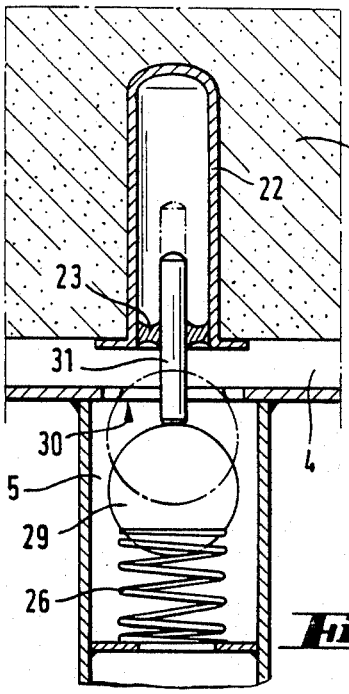
FIGS. 7–10 are partial sectional views of further embodiments of the present invention.

FIG. 7 illustrates an embodiment similar to FIG. 5, but wherein a pin or rod member 31 is formed on or contacts ball-shaped valve body 29 and is retained in sleeve 22 by a fuse, for example a soldered joint 23. This renewable fuse melts when the temperature rises due to the erosion or wearing of the sink 2. Upon melting of the fuse, the spring 26 presses the valve body 29 against toothed or star-shaped valve seat 30, and pin or rod member 31 is pushed into sleeve 22.

Figure 8:
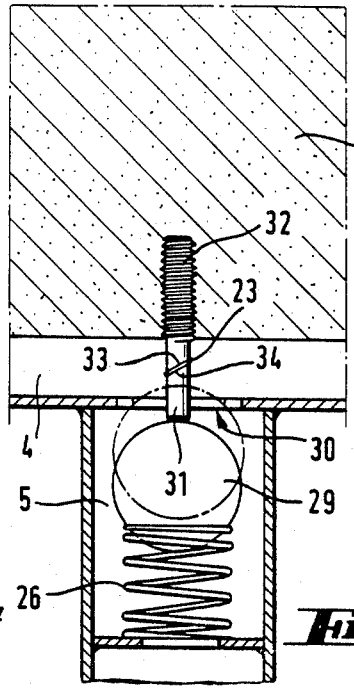

In the embodiment of FIG. 8, a bolt 32 having an inclined end face 33 is secured or embedded in sink 2, i.e. without the provision of sleeve 22. A pin or rod member 31 has a complementarily inclined end face 34. End faces 33, 34 are fused to each other by a soldered joint 23. Accordingly, when the sink 2 has been eroded or worn down to a predetermined extent or residual height, fuse 23 melts such that under the action of pressure spring 26 or under the action of the gas pressure alone the two faces 33, 34 are displaced relative to each other ball-shaped valve body 29 is allowed to seat on toothed or star-shaped valve seat 30.

Figure 9:
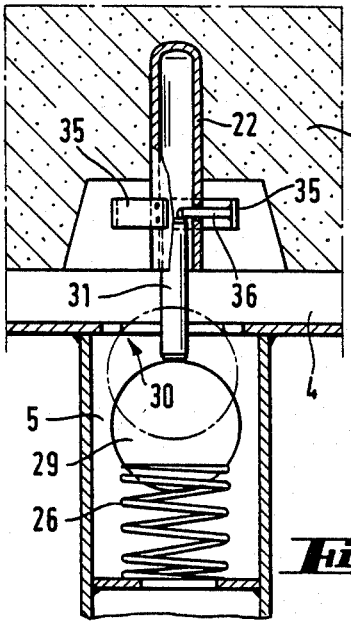

In the embodiment of FIG. 9, a bimetallic strip 35 is provided in place of a fuse. Thus, one end of bimetallic strip 35 is attached externally to a locating sleeve 22 embedded in sink 2. The other end of bimetallic stri 35 supports a locking or blocking bolt 36 which extends through an aperture in sleeve 22 and forms a stop for pin or rod member 31 of ball-shaped valve body 29. Pin or rod member 31 abuts bolt 36 to maintain valve body 29 in the open position spaced from valve seat 30. When the temperature rises as a result of erosion or wear, bimetallic strip 35 expands, thereby causing bolt 36 to be withdrawn from the opening in sleeve 22, thereby releasing pin or rod member 31 such that spring 26 urges valve body 29 to seat against valve seat 30. Here also, as in the embodiments of FIGS. 2–8, the total gas flow is reduced abruptly upon the occurrence of a predetermined extent of wear of brick or sink 2.

Figure 10:
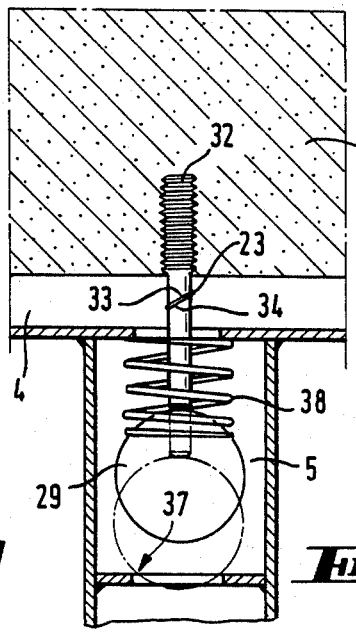

FIG. 10 illustrates an embodiment substantially similar to the embodiment of FIG. 8. However, in the embodiment of FIG. 10 the valve seat 37 is on the side of ball-shaped valve body 29 spaced away from sink 2. Accordingly, pressure spring 38 is provided on the side of valve body 29 adjacent sink 2. As long as soldered joint or fuse 23 is not melted, the valve body, attached to the rod member, is maintained in the open position spaced from valve seat 37, thereby allowing an unrestricted flow of gas. However, when the temperature rises such that fuse 23 melts, then the rod member and valve body 29 are allowed to drop and are urged by the force of spring 38 against valve seat 37, thereby causing the total gas flow to be reduced to a low value. Spring 38 is dimensioned such that the valve arrangement opens again to a reduced extent for continued purging when the gas pressure is increased. Also, it of course would be possible to provide valve seat 37 of a construction similar to that of valve seat 30.

Although the present invention has been described and illustrated with respect to preferred features, it is to be understood that various modifications and changes may be made to the specifically described and illustrated features without departing from the scope of the present invention. Further, it readily would be understood by one skilled in the art the manner in which a particular installation could be designed to cause reduction of the gas flow upon a temperature rise at a given position indicative of a given extent of erosion or wear of the gas purging or washing brick or sink.

We claim:

1. In a gas washing device for supplying gas through a metallurgical vessel to molten metal therein, said device including a gas permeable sink to be positioned to extend through a wall of a metallurgical vessel, said sink having an inner end to be exposed to the molten metal and subject to wear threby and an outer end, and gas inlet means for supplying an operational flow of gas from a gas supply to said outer end of said sink such that said gas flows through said sink into the molten metal, the improvement comprising:

means, operatively mounted with respect to said sink and responsive to a temperature rise indicative of an extent of wear of said inner end of said sink by the molten metal, said extent of wear being indicative of potential breakthrough of the molten metal, for reducing the flow of said gas to a reduced flow less than said operational flow upon said inner end of said sink being worn to said extent, said gas permeable sink comprising an inner brick and an outer brick confronting each other at a joint area, said inner and outer bricks abutting each other at a first portion of said joint area and being spaced from each other by a chamber at a second portion of said joint area, and said reducing means comprises a material which is meltable upon being subjected to said temperature rise, said material being positioned within said chamber, such that upon being melted said material forms a barrier to the flow of said gas at said second portion of said joint area and said gas flows only at said first portion of said joint area.

2. The improvement claimed in claim 1, further comprising means, operative associated with said gas inlet means, for detecting said reduced flow.

3. The improvement claimed in claim 1, wherein said material is granulated.

4. The improvement claimed in claim 1, wherein the area of said first portion is smaller than the area of said second portion.

5. The improvement claimed in claim 1, wherein said first portion extends peripherally and surrounds said second portion.

6. In a gas washing device for supplying gas through a metallurgical vessel to molten metal therein, said device including a gas permeable sink to be positioned to extend through a wall of a metallurgical vessel, said sink having an inner end to be exposed to the molten metal and subject to wear thereby and an outer end, and gas inlet means for supplying an operational flow of gas from a gas supply to said outer end of said sink such that said gas flows through said sink into the molten metal, the improvement comprising:

means, operatively mounted with respect to said sink and responsive to a temperature rise indicative of an extent of wear of said inner end of said sink by the molten metal, said exent of wear being indicative of potential breakthrough of the molten metal for reducing the flow of said gas to a reduced flow less than said operational flow upon said inner end of said sink being worn to said extent, said reducing means comprising a valve incorporated in said gas inlet means, said valve including a valve seat and a valve body movable between a first position spaced from said valve seat and a second position toward said valve seat, and temperature sensitive means for preventing said valve body from moving to said second position prior to said sink being worn in said extent.

7. The improvement claimed in claim 6, wherein said valve body comprises a gas permeable member seated tightly on said valve seat in said second position.

8. The improvement claimed in claim 7, wherein said valve body is bonded to said valve seat in said second position.

9. The improvement claimed in claim 6, wherein said valve body comprises a gas impermeable member defining with said valve seat a gas passageway in said second position.

10. The improvement claimed in claim 9, wherein said valve body is bonded to said valve seat in said second position.

11. The improvement claimed in claim 6, wherein said temperature sensitive means comprises a meltable fuse provided between a rod member contacting said valve body and a locating sleeve mounted on said sink.

12. The improvement claimed in claim 11, wherein said sleeve is connected to a star-shaped base member supporting said sink.

13. The improvement claimed in claim 11, wherein said sleeve is embedded in said sink.

14. The improvement claimed in claim 11, wherein said fuse comprises a meltable portion of said rod member.

15. The improvement claimed in claim 6, wherein said temperature sensitive means comprises a meltable fuse provided between a first rod member connected to said sink and a second rod member contacting said valve body.

16. The improvement claimed in claim 15, wherein said fuse is formed between inclined confronting end surfaces of said first and second rod members.

17. The improvement claimed in claim 6, wherein said temperature sensitive means comprises a bimetallic strip having a first end fixed relative to said sink and a second end blocking said valve body from moving to said second position before said temperature rise and deflective at said temperature rise to allow said valve body to move to said second position.

18. The improvement claimed in claim 6, further comprising spring means urging said valve body toward said valve seat in the direction of said gas flow.

19. The improvement claimed in claim 6, further comprising spring means urging said valve body toward said valve seat in a direction opposite to the direction of gas flow.

* * * * *